US006520628B2

(12) United States Patent
McClelland et al.

(10) Patent No.: US 6,520,628 B2
(45) Date of Patent: Feb. 18, 2003

(54) FLUID EJECTION DEVICE WITH SUBSTRATE HAVING A FLUID FIRING DEVICE AND A FLUID RESERVOIR ON A FIRST SURFACE THEREOF

(75) Inventors: Paul H McClelland, Monmouth, OR (US); John B Rausch, Boise, ID (US)

(73) Assignee: Hewlett-Packard Company, Palo Alto, CA (US)

( * ) Notice: Subject to any disclaimer, the term of this patent is extended or adjusted under 35 U.S.C. 154(b) by 0 days.

(21) Appl. No.: 09/772,543

(22) Filed: Jan. 30, 2001

(65) Prior Publication Data

US 2002/0101481 A1 Aug. 1, 2002

(51) Int. Cl.[7] ..... B41J 2/05; B41J 2/015
(52) U.S. Cl. ..... 347/65; 347/20
(58) Field of Search ..... 347/56, 63, 65, 347/47, 20, 67, 84–87

(56) References Cited

U.S. PATENT DOCUMENTS

| | | | | |
|---|---|---|---|---|
| 4,394,670 A | | 7/1983 | Sugitani et al. | 347/65 |
| 4,719,472 A | * | 1/1988 | Arakawa | 347/67 |
| 5,322,594 A | | 6/1994 | Bol | 216/27 |
| 5,758,417 A | * | 6/1998 | Kobayashi et al. | 347/63 |
| 6,135,586 A | * | 10/2000 | McClelland | 347/42 |
| 6,162,589 A | | 12/2000 | Chen et al. | 347/47 |

FOREIGN PATENT DOCUMENTS

| | | | |
|---|---|---|---|
| EP | 0500068 A2 | 8/1992 | B41J/2/175 |

OTHER PUBLICATIONS

ShinEtsu "Shin–Etsu Photosensitive Silicone Dielectrics SINR–Series", Date Unknown. For purposes of facilitating prosecution, applicant is willing to concede the information is prior art.

* cited by examiner

*Primary Examiner*—John Barlow
*Assistant Examiner*—Juanita Stephens
(74) *Attorney, Agent, or Firm*—Lucinda G. Price

(57) ABSTRACT

A process of manufacturing a printhead of a print bar by applying, on the same side of a glass substrate, a fluid firing device, a fluid reservoir supplying fluid to the fluid firing device, and drive electronics supplying power and signals to the fluid firing device. The fluid firing device has a firing chamber, a heating element beneath the firing chamber, a fluid ejection orifice, and a fluid channel directing fluid from the fluid reservoir to the heating element to be ejected through the orifice.

The fluid firing device has thin film layers. The thin film layers include a conductor layer that forms conductor traces that couple with the drive electronics. The thin film layers also include a cross-linked photoimagable polymer layer that forms the fluid channel, the firing ejection nozzle, and the firing chamber. In one embodiment, the firing chamber and the fluid ejection orifice are positioned over the heating element. In another embodiment, the fluid channel enters the firing chamber from a first side and the fluid is ejected from the firing chamber from a second side opposite the first side.

19 Claims, 14 Drawing Sheets

FLUID EJECTION DEVICE WITH SUBSTRATE HAVING A FLUID FIRING DEVICE AND A FLUID RESERVOIR ON A FIRST SURFACE THEREOF

FIELD OF THE INVENTION

This invention generally relates to thermal inkjet printing. More particularly, this invention relates to a printhead for a print bar and a process of manufacturing the printhead for the print bar. In particular the process includes applying, on the same side of a substrate, a fluid firing device, a fluid reservoir supplying fluid to the fluid firing device, and drive electronics supplying power and signals to the fluid firing device.

BACKGROUND OF THE INVENTION

One of the more important components of an inkjet printer is the inkjet printhead. The inkjet printhead controls the application of fluid to the printing medium (e.g., paper). Typically, inkjet printheads include a plurality of fluid ejection mechanisms and control circuitry formed on first side of a silicon substrate. The silicon substrate is connected to a fluid cartridge or other fluid supply located on a second side of the substrate. Channel structures formed through a slot in the silicon substrate or above the first side of the substrate direct the fluid from the fluid supply to the firing chambers. The control circuitry supplies current to the firing resistors in selected firing chambers. The fluid within the selected chambers is super-heated by the firing resistors, causing the fluid to be ejected through the chamber orifice toward the printing medium in the form of a fluid droplet.

The fluid ejection mechanism is made of thin film layers forming resistor, and a barrier layer forming firing chambers surrounding the resistors, and an orifice plate with orifices lined up with the firing chambers. The barrier layer channels the fluid to the resistor and defines the firing chamber volume. The barrier interface material is a thick, photosensitive material that is laminated onto the substrate, exposed, developed, and cured. The orifice plate is the exit path of the firing chamber that was defined by the barrier interface. The orifice plate is typically electroformed with nickel (Ni) and then coated with gold (Au), palladium (Pd), or other precious metals for corrosion resistance. The thickness of the orifice plate and the orifice opening diameter are controlled to allow repeatable drop ejection when firing.

Silicon is a relatively expensive material when compared with other substrate materials, such as glass. Semiconductor material such as silicon is typically used in the manufacturing of the control circuitry for the resistors. However, at least a portion of the silicon is often not optimally utilized in the printhead. For example, the silicon substrate has a fluid feed slot that is formed by making a hole in the silicon substrate. The silicon that is removed is considered a waste product of the printhead manufacturing process. In addition, the resistor is applied to the silicon substrate. It is desired to more economically and efficiently utilize the silicon substrates when manufacturing printheads.

SUMMARY OF THE INVENTION

In one embodiment of the present invention, a printhead has a glass substrate with a first surface, a fluid firing device deposited on the first surface, and a fluid reservoir positioned along the first surface. The fluid firing device has a firing chamber, a heating element beneath the firing chamber, a fluid ejection orifice, and a fluid channel directing fluid to the heating element to be ejected through the orifice. The fluid reservoir is coupled with the fluid channel.

Drive electronics are applied on the first surface and electronically coupled with the fluid firing device. The drive electronics supply power and signals to the fluid firing device to eject fluid from the fluid ejection orifice. The drive electronics include a control unit and an input connector coupled with a printer.

The fluid firing device has thin film layers. The thin film layers include a conductor layer that forms conductor traces that couple with the drive electronics. The thin film layers also include a cross-linked photoimagable polymer layer that forms the fluid channel, the firing ejection nozzle, and the firing chamber.

In one embodiment, the firing chamber and the fluid ejection orifice are positioned over the heating element. In another embodiment, the fluid channel enters he firing chamber from a first side and the fluid is ejected from the firing chamber from a second side opposite the first side.

A method of manufacturing the print head includes applying a fluid firing device on a first surface of a substrate, forming a fluid channel in the fluid firing device, applying a fluid reservoir on the first surface, coupling the fluid reservoir with the fluid channel, applying drive electronics onto the first surface, and electronically coupling the drive electronics with the fluid firing device.

In one embodiment, applying the fluid firing device includes depositing a thin film stack. The thin film stack includes a cross-linking polymer having a photoimagable material, wherein forming the fluid channel includes exposing the cross-linking polymer with electromagnetic energy. In one embodiment, a multi-density level mask is positioned over the polymer while exposing the polymer.

Many of the attendant features of this invention will be more readily appreciated as the same becomes better understood by reference to the following detailed description and considered in connection with the accompanying drawings in which like reference symbols designate like parts throughout.

Figure 1:
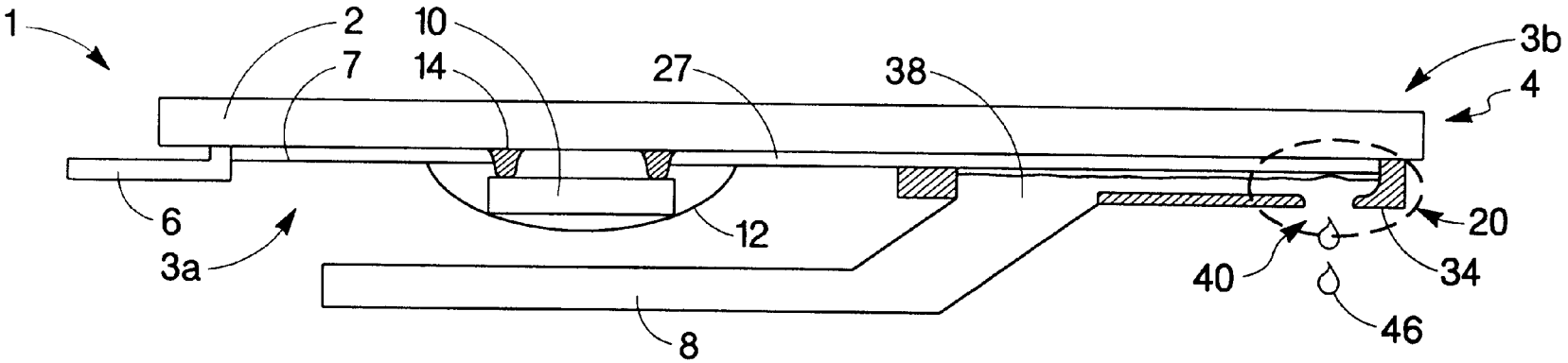
FIG. 1 illustrates a side view of a face-shooting print bar of the present invention.
Figure 7A:
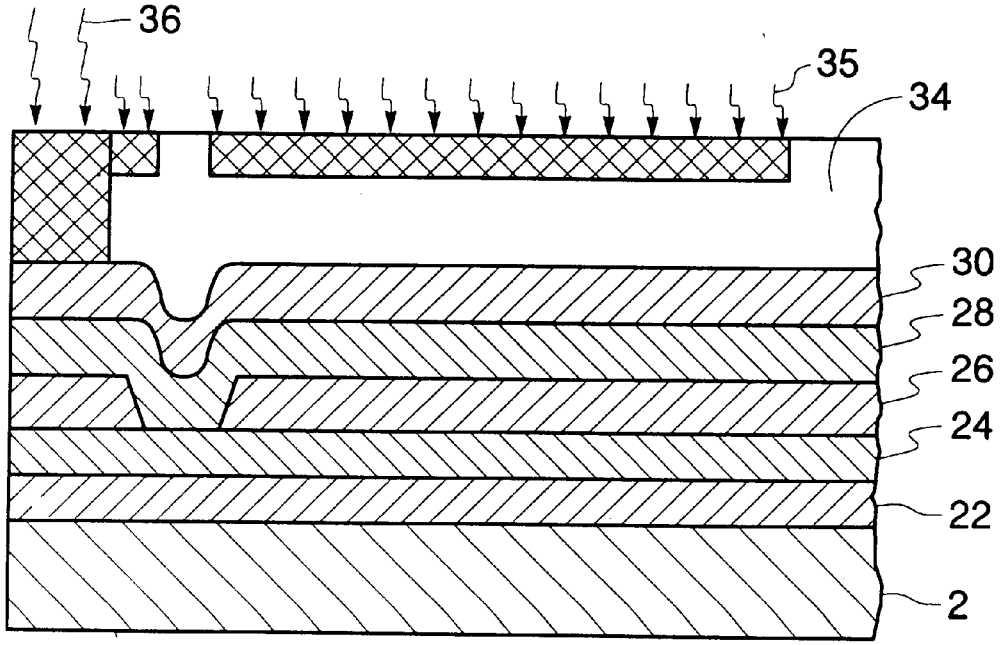
FIG. 7A illustrates a side view of a further step in the process of forming the face-shooting print bar of FIG. 1.
Figure 7B:
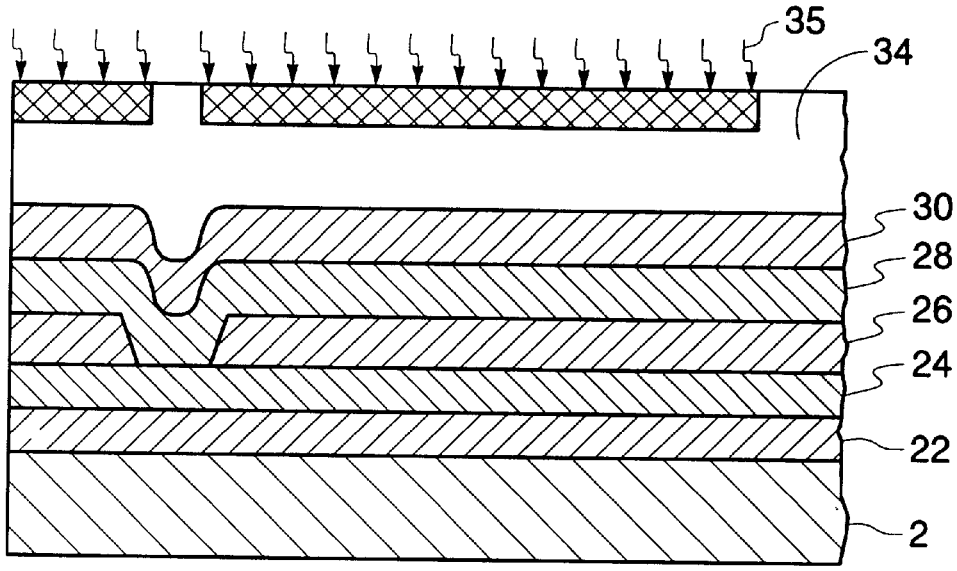
Figure 7C:
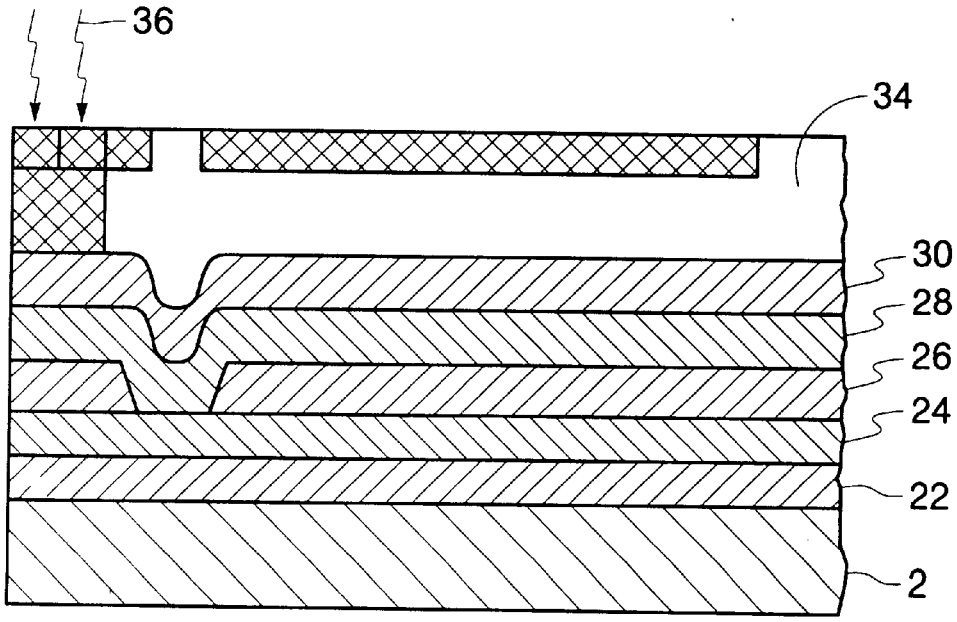
Figure 7D:
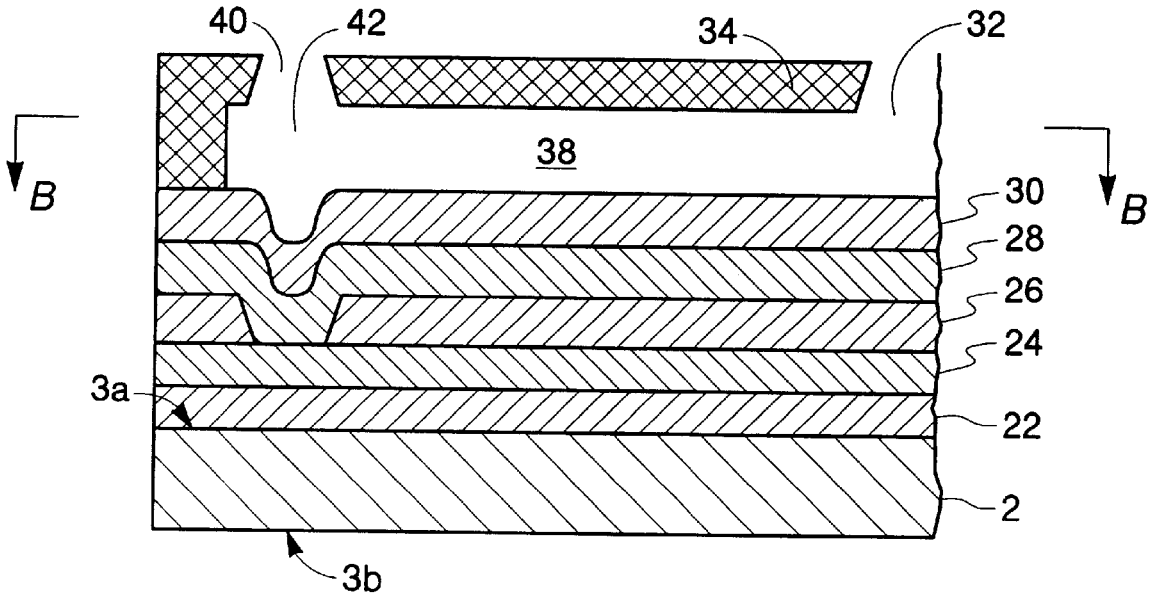
Figure 8A:
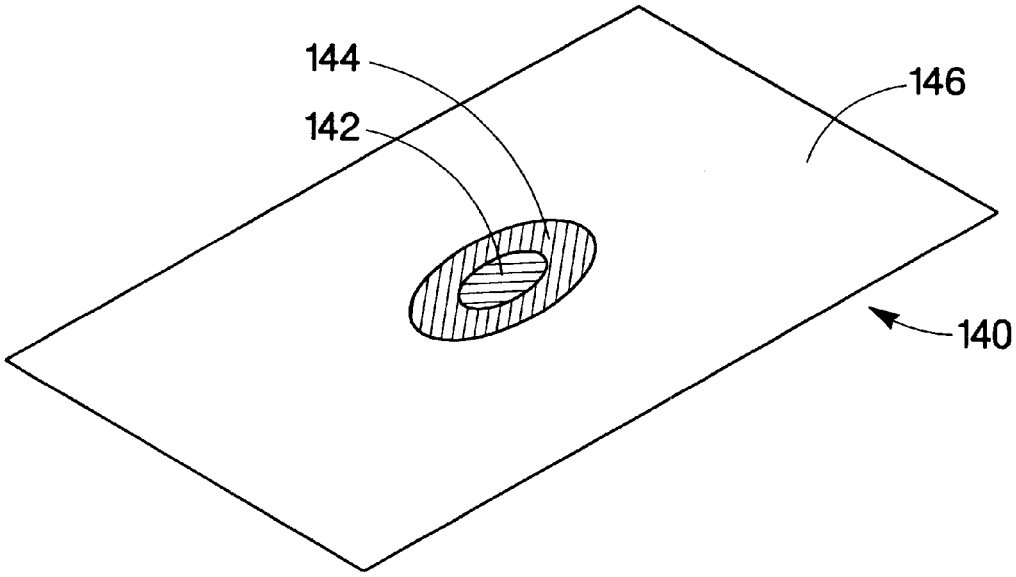
Figure 8B:
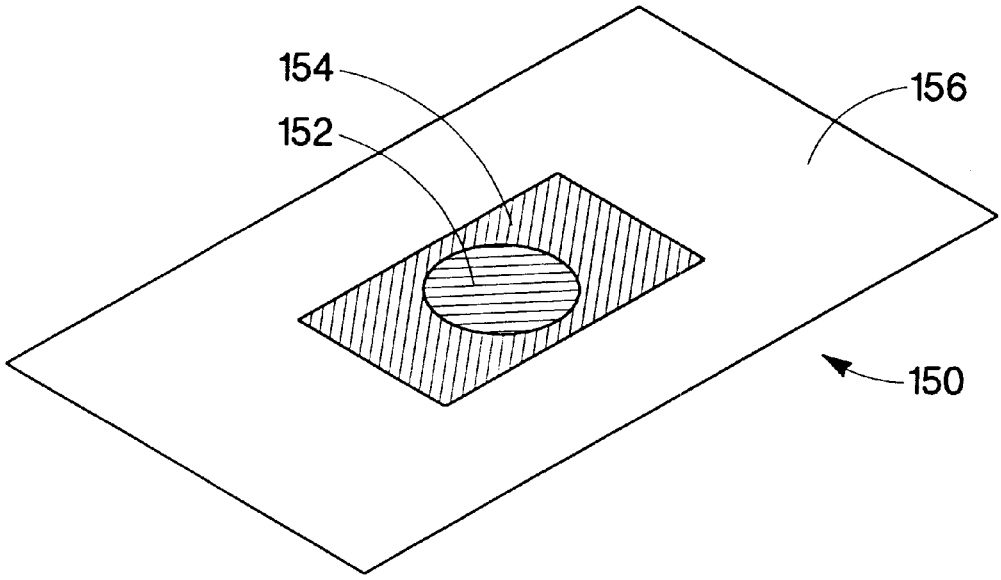
Figure 15:
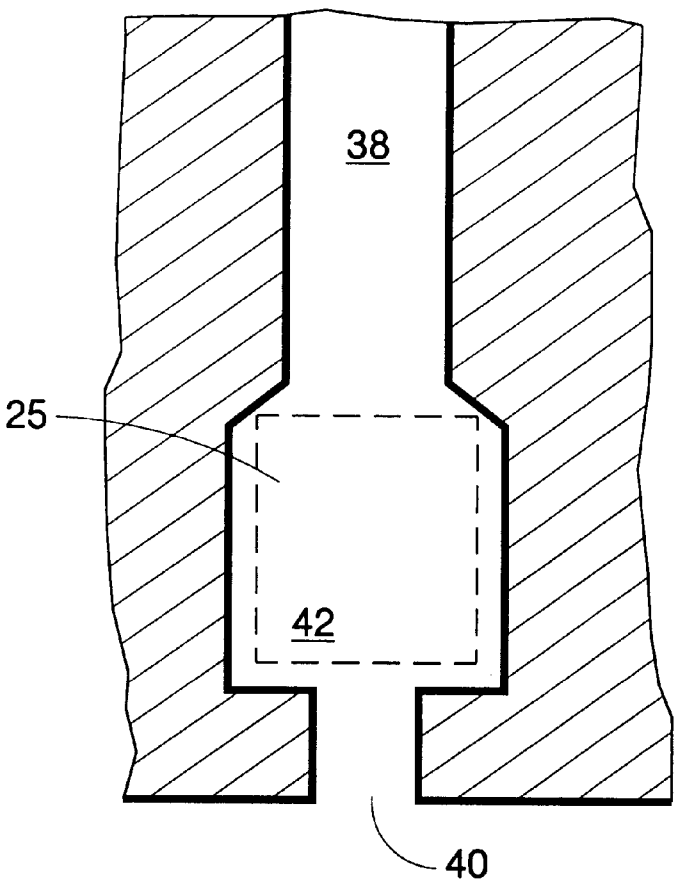
Figure 9:
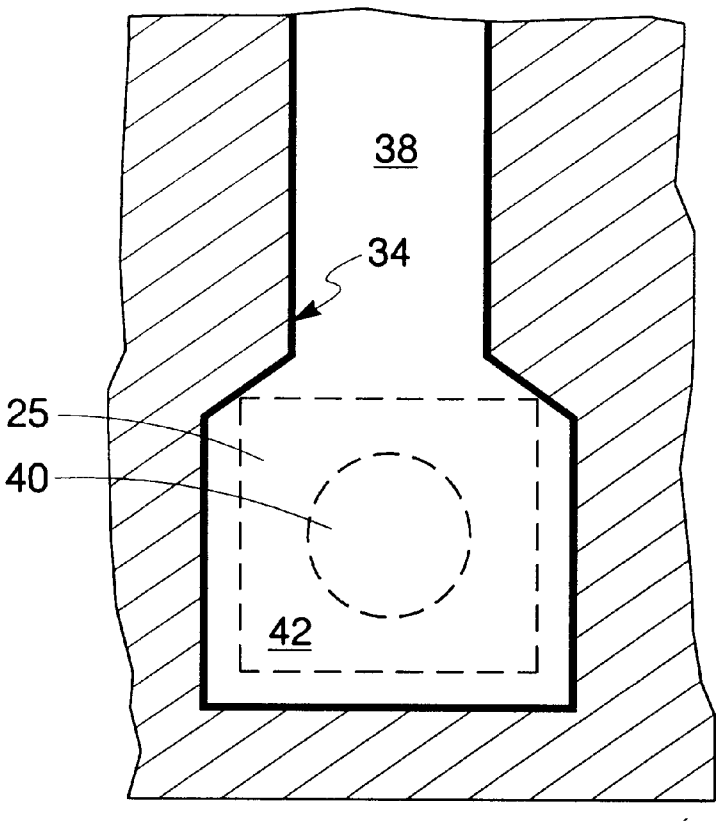
Figure 10:
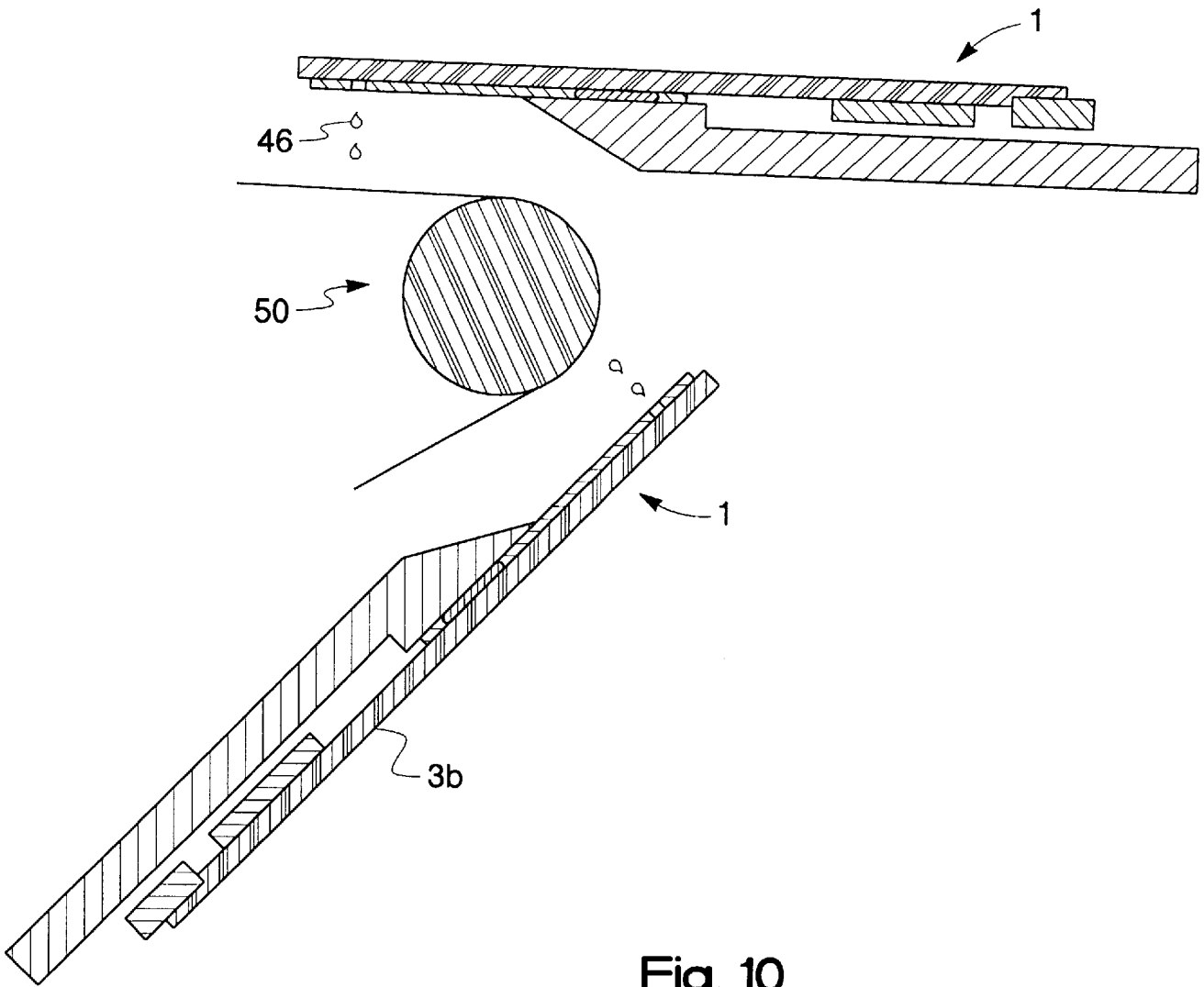
Figure 11:
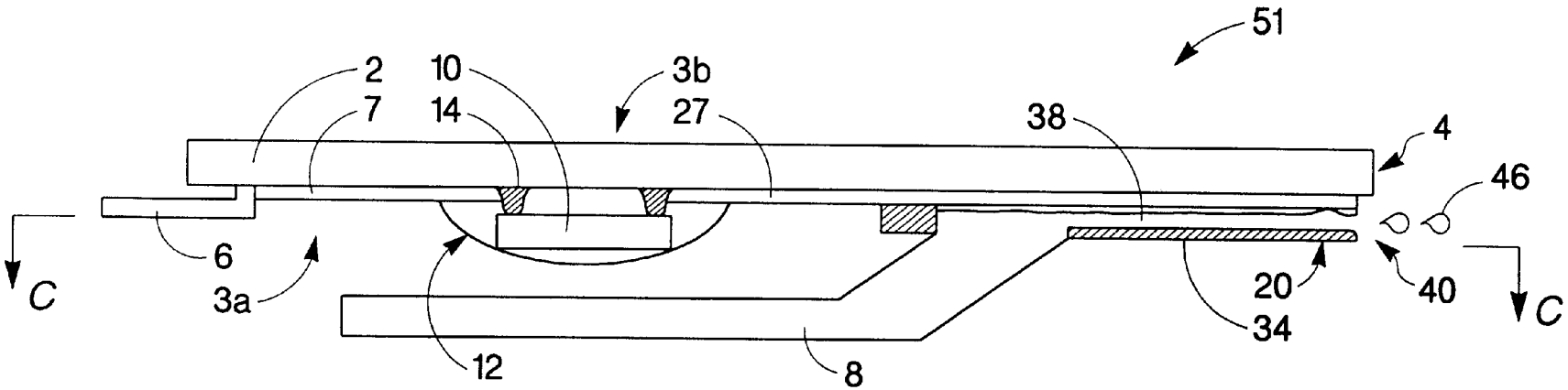
Figure 12:
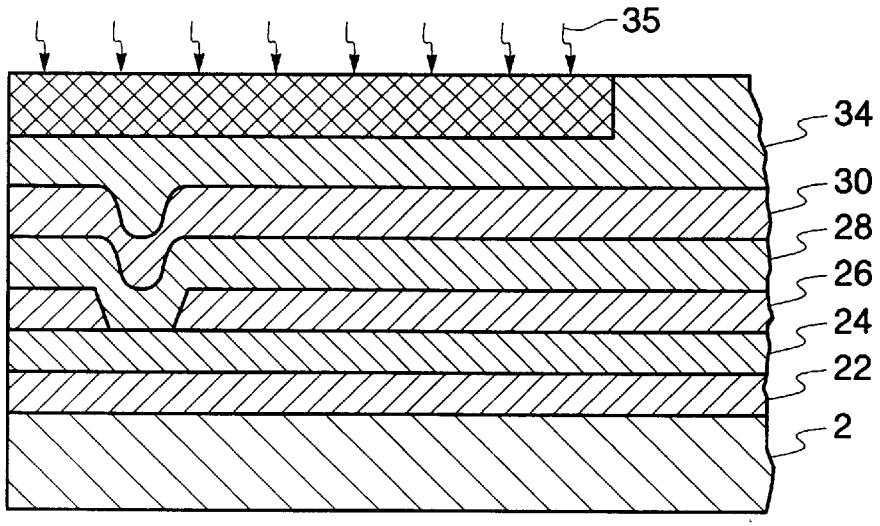
Figure 13:
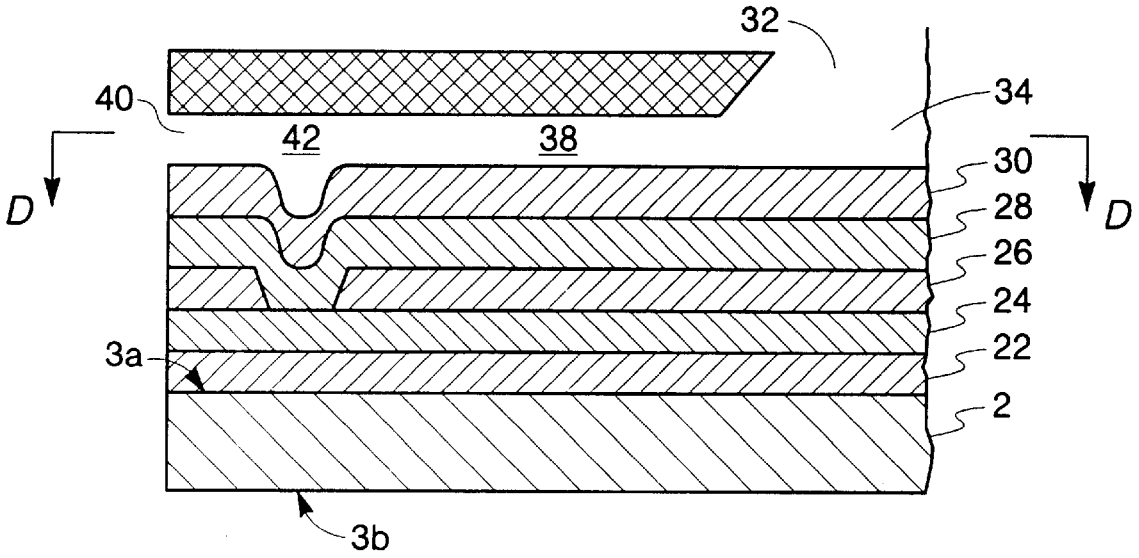
Figure 14:
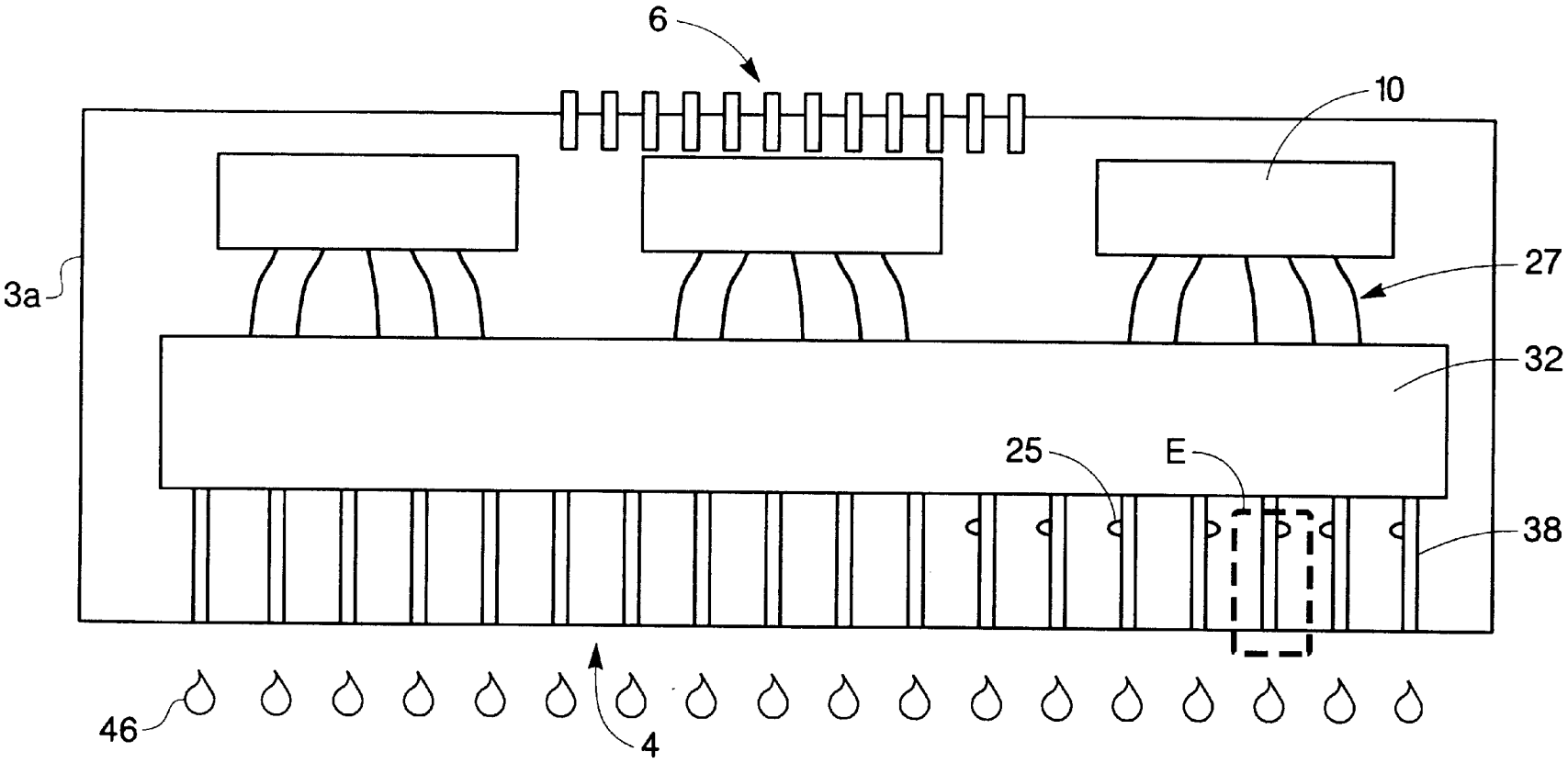
Figure 16:
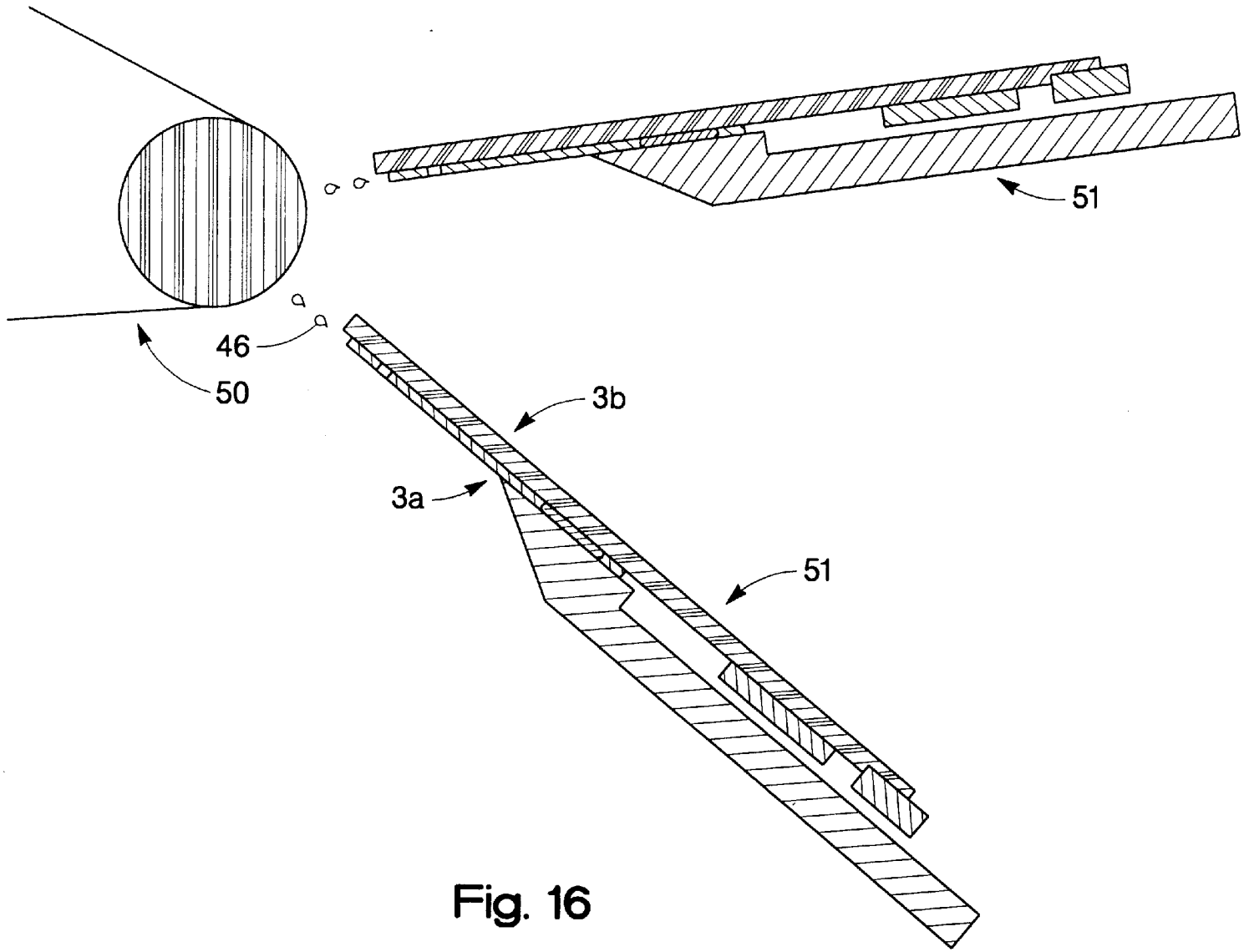

applying electromagnetic radiation to the photoimagable material layer using a multi-density level mask;

FIGS. 7B and 7C illustrate a side view of an alternative method of applying electromagnetic radiation to the photoimagable material layer using two masks;

FIG. 7D illustrates a side view of the front section of the print bar of FIG. 1;

FIGS. 8A and 8B illustrate multi-density level masks;

FIG. 8C through FIG. 8F illustrate the process to create the multi-density level mask used in the process of FIG. 7A;

FIG. 9 illustrates a sectional view of FIG. 7D through section B—B;

FIG. 10 illustrates two face-shooting print bars printing on a medium;

FIG. 11 illustrates a side view of an edge-shooting print bar of the present invention;

FIG. 12 illustrates a side view of a step in the process of forming the edge-shooting print bar of FIG. 11: applying electromagnetic radiation to the photoimagable material layer;

FIG. 13 illustrates a cross-sectional side view of the front section of the print bar of FIG. 11;

FIG. 14 illustrates a schematic cross-sectional view through section C—C of FIG. 11;

FIG. 15 illustrates area E of FIG. 14 through section D—D of FIG. 13; and FIG. 16 illustrates two edge-shooting print bars printing on a medium.

DETAILED DESCRIPTION

FIG. 1 illustrates a side view of a face-shooting print bar 1 of the present invention. Print bars use page wide printheads to print one or more lines at one time as a print media is advanced, line by line, in a direction perpendicular to a long axis of the printhead.

The print bar 1 has a substrate 2 with a first surface (or bottom side) 3*a* and a second surface 3*b*. Deposited on the bottom side 3*a* of the substrate are a fluid firing device 20 ejecting fluid 46, print bar drive electronics 6, 10 supplying power and electrical signals from a printer to the fluid firing device 20, and a fluid reservoir 8 coupled to and supplying fluid to the firing device. In the embodiment shown, the second surface 3*b* is a surface that is free of the components forming the print bar. The second surface 3*b*, as well as other exposed surfaces of the substrate is coated with a barrier and/or insulating layer (not shown).

Control units 10 electrically couple with the fluid firing device 20 through conductor traces 27. Each control unit 10 is encapsulated by an insulating and strain-relief layer 12. In one embodiment, the layer 12 is room temperature vulcanizing silicon rubber. In another embodiment, the layer 12 is a low temperature curing epoxy-based material. Input connectors 6 electrically couple the printer to the control units 10. Control units 10 electrically couple with the input connectors 6 through input lines 7. Each control unit has pads 14 which couple the control unit with the input lines 7 and the conductor traces 27. Alternatively, wires connect the drive electronics units 10 to both the input lines 7 and the conductor traces 27.

Figure 2:
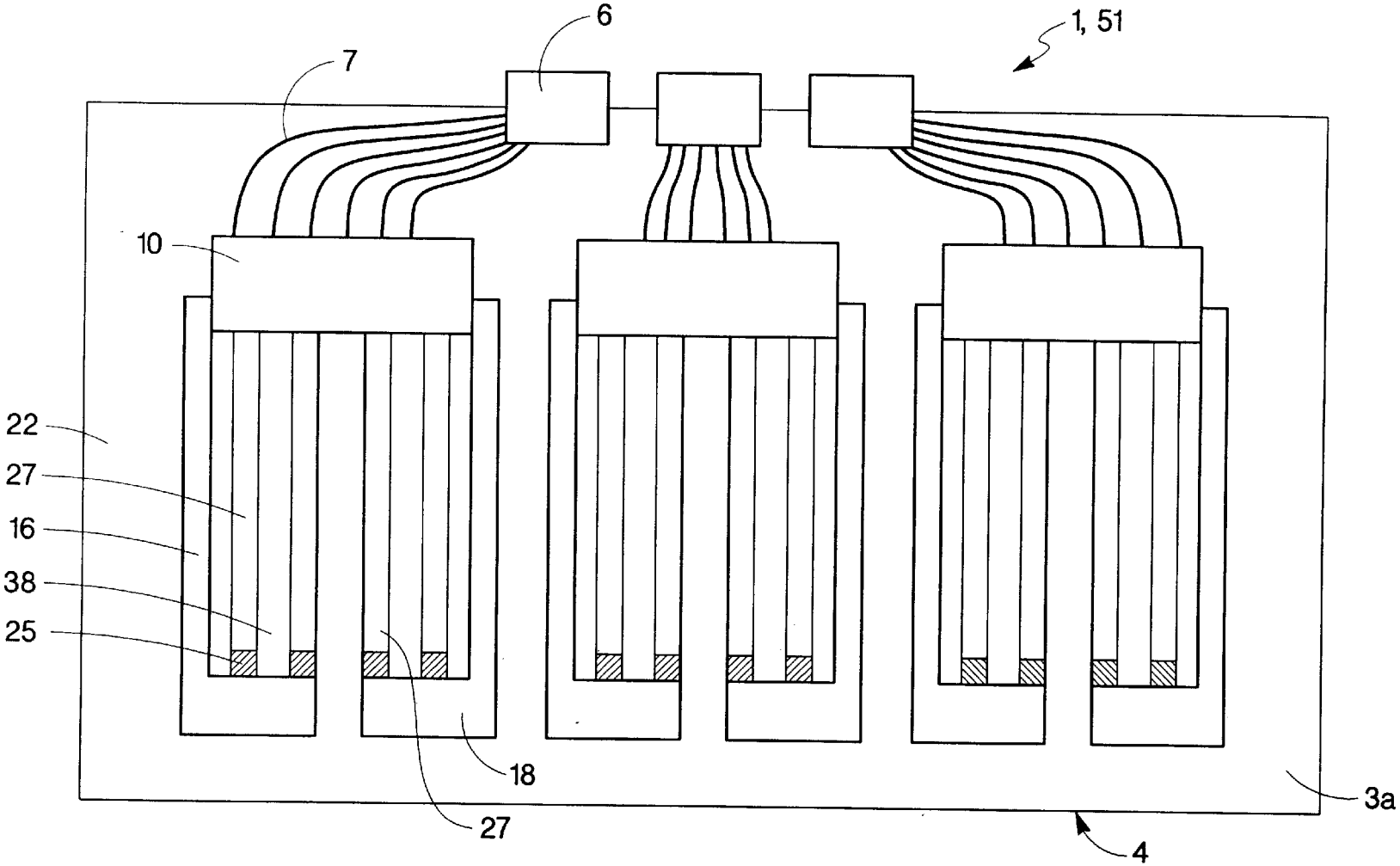
FIG. 2 illustrates a schematic plan view of a bottom surface of a print bar with a capping layer deposited over a substrate, an etched resistor layer, an etched conductor layer, and drive electronics.

Shown in FIG. 2 is a step in the process of forming the print bar of the present invention. For example, the fluid reservoir is not yet applied to the substrate in FIG. 2. Deposited on the bottom side 3*a* of the substrate 2 is a capping layer 22, the input connectors 6, the control units 10, and the conductor traces 27. Extending from each control unit 10 are the conductor traces 27, a first primitive connect 16 and a second primitive connect 18. In the embodiment illustrated, each primitive connect is used with two conductor traces 27. Alternative embodiments where there are either more or less conductor traces associated with each primitive connect is also within the spirit and scope of this invention.

Areas in between ends of the conductor traces 27 and the primitive connects 16, 18 are heating elements, or resistors 25. In between the substantially parallel conductor traces 27 are etched areas exposing the capping layer 22. In one embodiment, the fluid 46 flows over these etched areas to the heating elements 25. In another, the fluid 46 flows over the conductor traces, as shown in FIG. 9.

Figure 3:
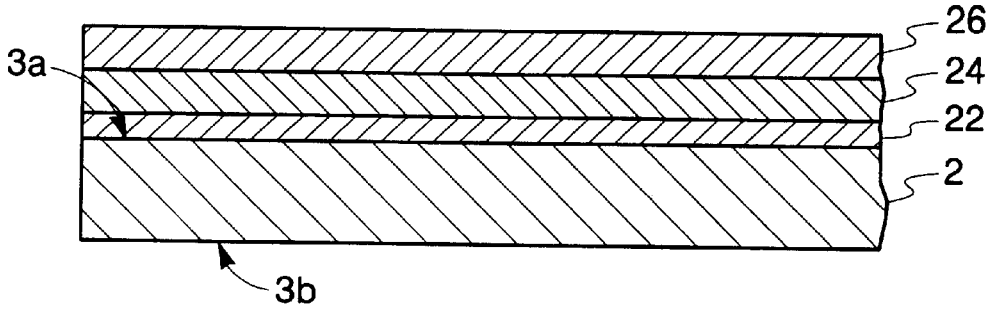
FIG. 3 illustrates a step in the process of forming the print bar of the present invention: a cross-section of the substrate coated with the capping layer, the resistor layer and the conductor layer.
Figure 4:
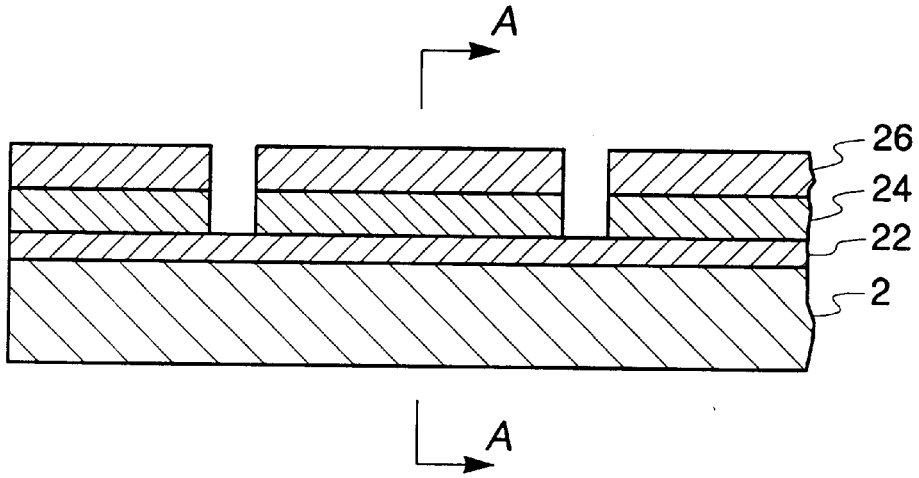
FIG. 4 illustrates a front view of another step in the process of forming the print bar of the present invention: a cross-section of the substrate coated with the capping layer, an etched resistor layer, and an etched conductor layer.
Figure 5:
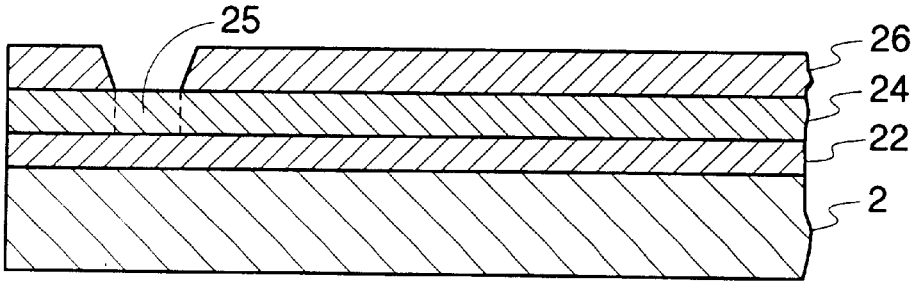
FIG. 5 illustrates a side view of the cross-section of FIG. 4 through section A—A.

FIGS. 3–5 illustrate the process of forming the conductor traces 27 and resistors 25. Applied over the substrate 2 is a thin film stack that forms part of the fluid firing device 20 The thin film stack of FIG. 3 includes the capping layer 22, a resistor layer 24, and a conductive layer 26. The substrate 2 is a glass substrate. Alternatively, the starting substrate may be a semiconductive material, such as silicon, a Metal Matrix Composite (MMC), a Ceramic Matrix Composite (CMC), a Polymer Matrix Composite (PMC) or a sandwich Si/xMc, in which the x filler material is etched out of the composite matrix post vacuum processing.

The capping layer 22 covers and seals the substrate 2, thereby providing a gas and liquid barrier layer. Capping layer 22 may be formed of a variety of different materials such as silicon dioxide, aluminum oxide, silicon carbide, silicon nitride, and glass. The use of an electrically insulating dielectric material for capping layer 22 also serves to insulate substrate 2 from the conductor traces 27. The capping layer may be formed using any of a variety of methods known to those of skill in the art such as sputtering, evaporation, and plasma enhanced chemical vapor deposition (PECVD). The thickness of capping layer 22 may be any desired thickness sufficient to cover and seal the substrate.

Firing resistors 25 are formed by depositing a layer 24 of resistive materials and a conductive layer 26 over the capping layer 22. The resistor layer 24 and the conductive layer 26 are then patterned, such as by photolithography, and etched to form the conductor traces (or vias) 27 and lines of resistor material directly beneath the conductor traces 27. Each line of etched resistor layer 24, as shown in the front cross-sectional view of FIG. 4, has substantially the same width as the above conductor trace 27. As shown in the side cross-sectional view of FIG. 5, through A—A of FIG. 4, each of the conductor traces 27 have an etched out area that forms individual resistors 25 from the resistor layer 24 underneath the conductor traces 27.

A variety of suitable resistive materials are known to those of skill in the art including tantalum aluminum, nickel chromium, titanium nitride and metal silicides, such as chrome silicide, which may optionally be doped with suitable impurities such as oxygen, nitrogen, and carbon, to adjust the resistivity of the material. The resistive material may be deposited by any suitable method such as sputtering, and evaporation. Typically, the resistor layer has a thickness in the range of about 100 angstroms to 500 angstroms. However, resistor layers with thicknesses outside this range are also within the spirit and scope of the invention.

The conductive layer 26 may be formed of any of a variety of different materials including aluminum, aluminum/copper (4%), copper, titanium nitride, and gold, and may be deposited by any method, such as sputtering and evaporation. In general, the conductive layer has a thickness of 5000 to 20,000 angstroms depending upon the material used. One skilled in the art understands that thicknesses outside of this range is within the scope and spirit of the invention.

Figure 6:
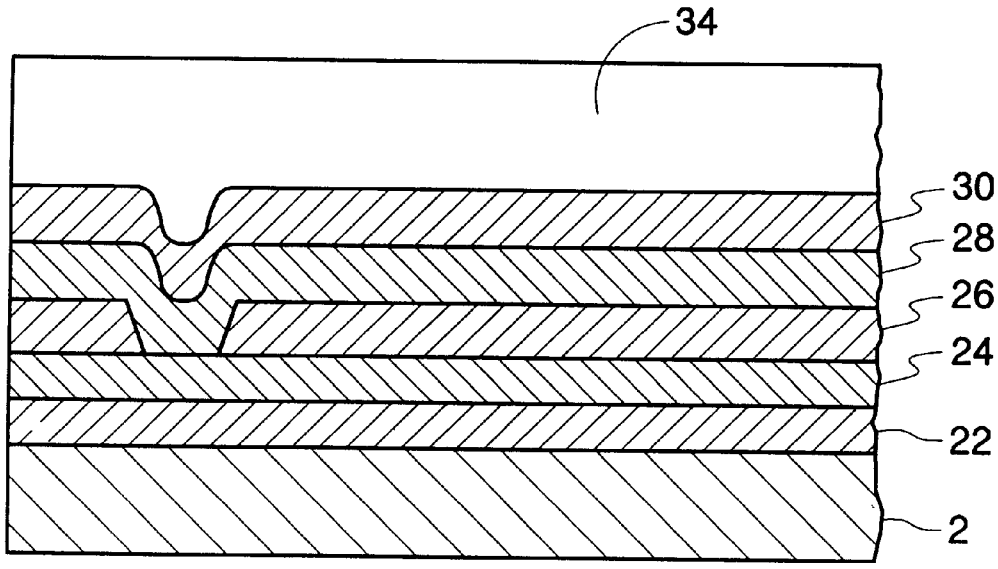
FIG. 6 illustrates a side view of another step in the process of forming the print bar of the present invention: a cross-section of the front section of the substrate coated with the capping layer, an etched resistor layer, an etched conductor layer, a passivation layer, a cavitation barrier layer, and a photoimagable material layer.

In FIG. 6, several layers have been added to the thin film stack of FIG. 5. An insulating passivation layer 28 is formed over the resistors and conductor traces to prevent electrical charging of the fluid or corrosion of the fluid firing device (in particular the conductor traces). The passivation layer 28 may be formed of any suitable material such as silicon dioxide, aluminum oxide, silicon carbide, silicon nitride, zirconium oxycarbide and glass, and by any suitable method such as sputtering, evaporation, and PECVD.

Alternatively, the passivation layer 28 may be omitted if a non-conductive fluid is used. In another alternative embodiment as shown in FIG. 6, cavitation barrier layer 30 is added over the passivation layer 28 or in place of the passivation layer. The cavitation barrier layer 30 helps dissipate the force of the collapsing drive bubble left in the wake of each ejected fluid drop. In one embodiment, the cavitation barrier layer is tantalum.

A photoimagable material layer 34 is formed over the cavitation barrier layer 30, as shown in FIG. 6. The photoimagable layer 34 is comprised of fast cross-linking polymer such as photoimagable epoxy (such as SU8 developed by IBM), photoimagable polymer or photosensitive silicone dielectrics, such as SINR-3010 manufactured by ShinEtsu™. The photoimagable material layer 34 replaces the nickel orifice plate and the barrier interface material described in the Background of the Invention.

Using the photoimagable polymer layer 34 to replace the nickel orifice plate and the barrier interface material increases productivity as well as ensures accuracy of orifice placement. For example, the following steps are eliminated: forming the orifice plate, attaching the orifice plate to the barrier material, and aligning the orifice plate over the firing chamber. Alternatively, using an orifice plate to form the nozzles and a barrier interface material to form the firing chambers is within the spirit and scope of the invention.

In the present embodiment, the cross-linking polymer is applied using a conventional spin-coating tool such as those manufactured by Karl Suss K G. The spin-coating process associated with the spin-coating tool allows for a planar surface to be formed as the cross-linking polymer fills the surface of the stack of thin-film layers 20. Polymer material planarizes over thin-film topographies. This feature provides a consistent drop trajectory.

Alternative polymer application processes include roll-coating, curtain coating, extrusion coating, spray coating, and dip-coating. Those skilled in the art will appreciate that other methods to apply the polymer layers to the substrate exist and still fall within the spirit and scope of the invention. The cross-linking polymer is made by mixing optical dye (such as orange #3) into either a photoimagable polyimide or photoimagable epoxy transparent polymer material. By adding the dye, the amount of electromagnetic energy required is greater than non-dye mixed material to crosslink the material.

There are many different materials that can be made into materials with negative acting photoresist properties. The negative acting photoresist materials are formed by adding a photoactive agent to a material such as polyimide, epoxy, polybenzoxazoles, benzocyclobutene, and sol gels. Those skilled in the art will appreciate that there are still other negative acting photoresist polymer materials that fall within the spirit and scope of the invention. By adding optical dye (such as Orange #3) to transparent polymer material, a slow photoresist can be made from fast photoresist that has no dye or a small amount of dye. Another embodiment would be to coat a layer of polymer material with a thin layer of dye. Alternative methods to create slow photoresist comprise mixing polymers with different molecular weights, with different wavelength absorption characteristics, with different developing rates, and using pigments. Those skilled in the art will appreciate that other methods to slow the photosensitivity of polymers fall within the spirit and scope of the invention.

The photoimagable layer produces a top-hat shaped reentrant (directed inwards) profile orifice. The top-hat orifice can be tailored by varying process parameters to optimize drop ejection characteristics. This top-hat design topology offers several advantages over straight walled or linear tapered architectures. The tophat shaped reentrant orifice chamber is defined by a firing chamber 42 and an orifice chamber 40, as shown in FIG. 7D. The firing chamber and the orifice chamber form part of the fluid firing device 20. Fluid 46, such as ink (as shown in FIG. 10), flows into the firing chamber 42 from the fluid reservoir 8 via the fluid channel 38 and is heated by energy dissipation element (resistor) 25, thereby forming a fluid vapor bubble that forcibly ejects the remaining fluid 46 from the top-hat shaped reentrant orifice chamber. The orifice (and orifice chamber) 40 in this embodiment is located opposite the firing resistor 25 in the firing chamber 42. Therefore, the fluid 46 is ejected in a direction away from the substrate surface, hence the print bar is a face-shooting print bar 1.

The area and shape of each orifice chamber, as viewed looking into the orifice, is defined by using a patterned mask (for example, either mask 140 or mask 150 as shown in FIGS. 8A and 8B). Alternative, a set of masks is used to define the orifice chamber. FIG. 7A illustrates a process of using electromagnetic radiation to cross-link the photoimagable material layer 34 using a single mask, the mask 140 or 150, and is described in more detail below. FIGS. 7B and 7C illustrate the process of using electromagnetic radiation to cross-link using two masks, as described in more detail below. The masks allow for controlling the entrance diameter, exit diameter and firing chamber volume based on the orifice layer thickness or height. The height of the orifice chamber and the height of the firing chamber are independently controlled to allow for optimum process stability and design latitude. By controlling the shape, area and height of the orifice and firing chambers, the designer can control the drop size, drop shape, and dampen the effect of the blowback or cavitation (that part of the bubble which expels the fluid that expands opposite to the direction of drop ejection) and to some extent the refill speed (the time required to have fluid fill the entire top-hat orifice structure).

FIG. 7A illustrates exposure of the layer of cross-linking polymer 34 to electromagnetic energy to define the orifice opening 40, the firing chamber 42, and the fluid channel 38 using the multi-density level mask 140 or 150 of FIGS. 8*a* and 8*b*, respectively. The cross-linking polymer layer 34 is exposed to a low dosage of electromagnetic energy 35, and a high dosage of electromagnetic energy 36 when covered with the mask 140 or 150.

The low exposure dosage 35 underexposes and cross-links the cross-linking polymer 34 to a desired depth to define the thicknesses of the orifice opening 40 as well as the fluid channel, where cross-linked areas are shown as "X" in the Figures. The total energy expended during this step cross-links the cross-linking polymer layer 34 to a certain depth, either by limiting the intensity or time of exposure or a combination of both. In an exemplary embodiment, this step is done using a Canon™ Micralign tool PLA 600 FA set to an exposure amount that is in a range of about 200 to 600 mjoules.

The high exposure dosage 36 cross-links the entire thickness of the polymer layer 34 to define the volume of the firing chamber 42. A range of about 1000 mJoules to about 2000 mJoules would provide adequate exposure, depending upon the properties of the cross-linking polymer 34, and the desired depth of cross-linking. This technique provides for precision alignment of the orifice opening 40 and firing chamber 42. Because the single mask, mask 140 or 150, is used, the number of process steps is minimized. Further, this approach reduces the possible alignment mistakes when using two separate masks.

The non cross-linked material is removed from the firing chamber, and orifice chamber, through a developing method to form the orifice opening 40, the firing chamber 42, and the fluid channel 38, as shown in FIG. 7D. To wash away the non cross-linked material, a spin/spray developer such as a 7110 Solitec developer tool uses a solvent such as NMP, gamabutyrallactone (GBLO), or propylene glycolmonoethylacetate (PGMEA). The spin rate and time that the substrate is exposed to the solvent depends upon the temperature solvent, exposure dose of polymer, and solvent material.

As shown in FIG. 7D, the orifice chamber has a slight reentrant taper due to less cross-linking of material in the depth of layer of cross-linking polymer 34. The dye or other material mixed within the cross-linking polymer material attenuates the electromagnetic energy as it penetrates therethrough.

Note that there are two openings in the polymer layer 34. One opening is the orifice opening 40. The second opening is a fluid supply opening 32 that couples to the fluid reservoir 8, allowing the fluid to flow from the reservoir 8 through the channel 38 to the heating elements 25.

An exemplary orifice has a orifice 40 diameter of about 60 $\mu$m, the firing chamber 42 length of about 140 $\mu$m, a firing chamber 42 width of about 120 $\mu$m, a orifice opening 40 thickness of about 30 $\mu$m, and a fluid channel 38 height of about 50 $\mu$m.

As shown in FIGS. 8A and 8B, the mask 140, 150 is comprised of three separate density regions 146, 144, 142, 156, 154, 152, respectively, per orifice opening forming the multi-density level mask 140, 150. One region is essentially non-opaque to the electromagnetic energy. The second region is partially opaque to the electromagnetic energy. The third region is completely opaque to the electromagnetic energy.

The first region (non-opaque) 146, 156 is transparent to the electromagnetic energy, allows a strong intensity of electromagnetic energy 36 to pass through the mask to fully cross-link and define the orifice layers where no photoimagable material is to be removed during developing. The second region 144, 154 is designed for a lower intensity of electromagnetic energy 35 to cross-link through a predetermined depth of the layer 34, such that material 34 that is not cross-linked may be removed during developing to form the fluid channel 38. The third region (fully opaque) 142, 152 is used to define the shape and area of the orifice opening 40. Because no electromagnetic energy is allowed through this third region, the cross-linking polymer beneath the opaque third region of the mask will not be exposed, thus will be removed when developed. In this embodiment, an exemplary mask would have a transmission rate for non-opaque area 146, 156 of about 100%, a transmission rate for partially opaque area 144, 154 of about 20%, and the transmission rate for opaque area 142, 152 of about 0%.

FIG. 7B and 7C illustrate the process of using electromagnetic radiation to cross-link using two masks, to replace the step shown in FIG. 7A. A first mask (not shown) is placed over the cross-linking polymer layer 34 and exposed to a low dosage of electromagnetic energy 35 to define the height of the orifice opening 40 and height of the fluid channel 38. In FIG. 7C, the first mask is replaced with a second mask (not shown). The cross-linking polymer layer 34 is exposed to a high dosage of electromagnetic energy 36. The cross-linked areas in the polymer layer 34 shown in FIG. 7C is substantially the same as that shown in FIG. 7A.

In an alternative embodiment, more than one photoimagable material layer (not shown) is formed over the cavitation barrier layer. Each photoimagable layer formed has a different rate of cross-linking for a given intensity of energy. The direct imaging polymer orifice has two or more layers of negative acting photoresist materials with slightly different dissolution rates. The dissolution rates are based on the different materials of each layer having a different molecular weight, physical composition, or optical density.

A method similar to the one illustrated in FIGS. 7B and 7C is described using multiple photoimagable layers. In the embodiment using two cross-linking polymer layers, a "slow" photoresist is applied over the thin film stack on the substrate. A "fast" photoresist is applied over the layer of slow photoresist. After curing, the substrate photoresist layers are exposed through a single mask (not shown) at a very high intensity of at least about 500 mJoules/cm$^2$ to define the firing chamber. The intensity is high enough to cross-link both the top (the fast photoresist) and bottom (the slow photoresist) layers. The substrate photoresist layers are then exposed through another mask (not shown) with low intensity electromagnetic energy of about 100 mjoules/cm$^2$ to define the orifice chamber. The intensity of the second exposure is such that the lower orifice layer of slow photoresist that is beneath the orifice opening is not cross-linked. Alternative methods of exposing the cross-linking polymer layers may be used, including reversing the application of dosage of electromagnetic energy and using a single mask.

Figure 8C:
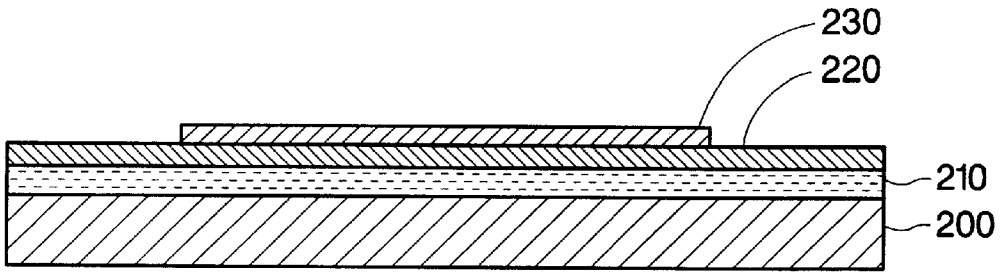

Shown in FIGS. 8C to 8F is the process of manufacturing the multi-density level mask 140 or 150 used in the single mask fabrication processes to make the holes in the orifice layer 40. FIG. 8C illustrates a quartz substrate 200 that is transparent to the electromagnetic energy used to expose the photoimagable polymer used to create the orifice layers. The quartz substrate 200 is of a suitable optical quality. The substrate 200 has a layer of semi-transparent dielectric material 210 applied on it. Such an exemplary material is ferrous oxide ($FeO_2$). On the layer of semi-transparent dielectric material 210 is applied a layer of opaque material 220, an exemplary material being chromium. Both $FeO_2$ and chromium can be deposited using a conventional e-beam evaporator. A layer of negative acting photo-resist is applied on the layer of opaque material 220, exposed to electromagnetic energy and developed to leave a photoresist area 230 which defines the shape and size of the firing chamber.

Figure 8D:
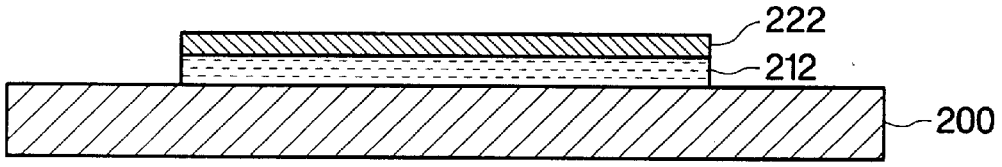

FIG. 8D illustrates the result after the quartz substrate 200 has been conventionally etched. When the opaque material 220 is comprised of chromium, then an exemplary etch process is a standard KTI chromium etch bath. The quartz substrate 200 is then subjected to another conventional etch process to remove the semi-transparent dielectric material 210 forming semi-transparent layer 212. When $FeO_2$ is used for the semi-transparent dielectric material 210 an exemplary etch process is a plasma etch using an SF6 or CF4 plasma. The remaining photoresist 230 is then stripped.

Figure 8E:
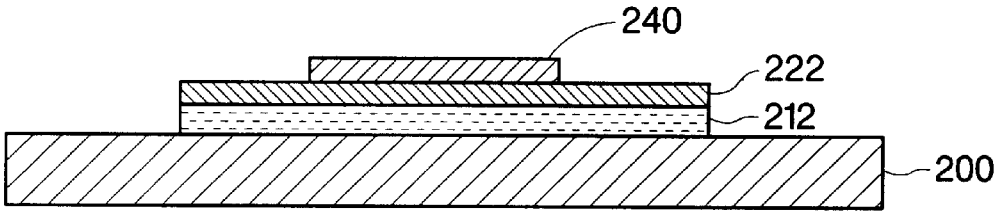
Figure 8F:
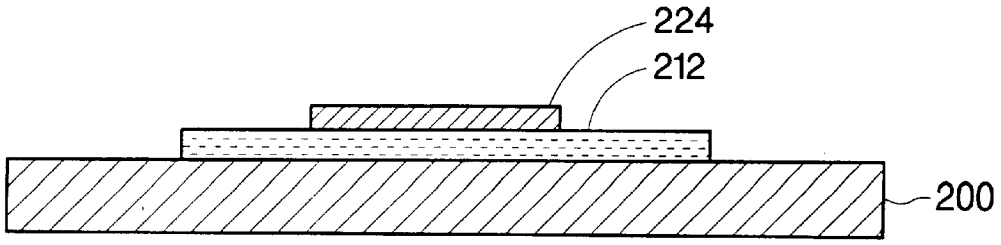

In FIG. 8E another layer of photoresist is then applied to the quartz substrate 200, exposed to define the orifice opening shape and area then developed to create orifice pattern 240. FIG. 8F illustrates the result after the quartz substrate 200 is processed in an etch to remove the opaque layer 222 where the orifice pattern 240 is not located thereby creating the opaque layer orifice opening pattern 224. For an opaque material that is chromium, an exemplary etch process is a wet chemical etch so that semi-transparent dielectric layer 212 is not attacked in the etch process.

FIG. 9 illustrates a sectional view of FIG. 7D through section B—B. FIG. 9 is a top view of the print bar 1, in particular the firing chamber 42 and the fluid channel 38 leading thereto. As shown and described above, the fluid channels and firing chambers 38, 42 are formed by the cross-linked polymer layer 34. The orifice 40, shown in dashed lines, opens above the resistor 25 to allow fluid to eject from the firing chamber. The resistor 25 is also shown in dashed lines, because the resistor is covered by the passivation layer 28 and/or the cavitation barrier layer 30, as shown in FIG. 7D.

Various characteristics of the fluid ejection, such as droplet shape, trajectory, and collapse volume are controlled through controlling the firing chamber volume and orifice opening volume. It will be appreciated by those of skill in the art that many different firing resistor and firing chamber shapes and configurations are possible within the spirit and scope of the invention including donut shapes, star shapes, serpentine patterns, zigzag patterns, and checkerboard patterns. Two such shapes are shown in FIGS. 9 and 15.

In addition to the examples mentioned above, a circumferential firing resistor is another example of the many different complex resistor designs which are possible and which allow improved fluid ejection characteristics. One type of circumferential resistor is referred to herein as a "box" resistor. After depositing the resistive layer over capping layer 22, firing resistors 25 are patterned to define a rectangular ring. Alternatively, the circumferential resistors may take any other suitable shape (e.g., circle, oval, and triangle).

FIG. 10 illustrates two face-shooting print bars 1 printing on a medium 50, such as used for cash register receipts, ATM receipts, and printing commercial bar codes. Each print bar 1 may have a different function. A first print bar may have a function of printing customer independent information, such as advertisements, logos, and the current time. A second print bar may have a function of printing customer dependent information, such as purchase items, amount of purchase, and customer account information. In another alternative embodiment, one or both print bars may have color printing capability. It will be appreciated by those of skill in the art that color print bars using the present invention are possible and within the spirit and scope of the invention.

In one embodiment of the present invention, the print quality is up to about 300 lines per inch, and the print bar is about 2 ½ to 3 inches (about 6 ½ to 8 centimeters) in length. In another embodiment, the print quality is from about 150 to 200 lines per inch.

FIG. 11 illustrates a side view of an edge-shooting print bar 51 of the present invention. The edge-shooting print bar 51 is similar to the face-shooting print bar 1. The main difference is as follows: for the edge-shooting print bar 51 the orifice 40 in the polymer layer 34 is located adjacent the firing resistor 25. Therefore, the fluid 46 is ejected in a direction toward the front section 4 of the substrate 2, and in a direction away from the fluid reservoir 8, hence the print bar 51 is edge-shooting.

FIGS. 2 through 6 and the accompanying description applies to the edge-shooting print bar 51, as well as the face-shooting print bar 1. However, the method of forming the fluid channel 38 in the print bar 51 is different. FIG. 12 illustrates a side view of a step in the process of forming the fluid channel 38 of the edge-shooting print bar 51 of FIG. 11. Similar to the method described with respect to FIG. 7B, the low exposure dosage 35 underexposes and cross-links the cross-linking polymer 34 to a desired depth to define the thicknesses of the orifice opening 40 as well as the fluid channel 38. The total energy expended during this step cross-links the cross-linking polymer layer 34 to a certain depth, either by limiting the intensity or time of exposure or a combination of both. In an alternative embodiment, a mask (not shown) is placed over the polymer layer 34 to form the opening 32 for the fluid reservoir. In another alternative embodiment, a mask is placed over the polymer layer 34 to form the fluid channel 38 having a non-uniform height. It will be appreciated by those of skill in the art that the non-uniform heights may be formed using methods previously described herein and are within the spirit and scope of the invention.

As shown in FIG. 13, the non cross-linked material is removed from the firing chamber 42, and orifice chamber 40 in a manner similar to that previously described with respect to FIG. 7D. Again, the orifice chamber 40, as well as the opening 32 for the fluid reservoir 8 has a slight reentrant taper due to less cross-linking of material in the depth of layer of cross-linking polymer 34.

FIG. 14 illustrates a schematic plan view through section C—C of FIG. 11. The opening 32 for the fluid reservoir 8 is shown, as well as the fluid channels 38 leading to the heating elements 25. Conductor traces 27 electrically connect the control unit 10 to the heating elements 25 of the firing device 20. Fluid 46 is ejected from the front section 4 of the substrate 2 by the firing device 20.

FIG. 15 illustrates area E of FIG. 14 through section D—D of FIG. 13. FIG. 15 is a top view of the firing chamber 42 and the fluid channel 38 leading thereto, similar to FIG. 9. The fluid channels and firing chambers 38, 42 are formed by the cross-linked polymer layer 34. The orifice 40 opens to the front section 4 of the substrate to allow ink to eject from the firing chamber.

FIG. 16 illustrates two edge-shooting print bars 51 printing on a medium 50. The two print bars 51 function in a manner similar to the print bars 1 as previously described with respect to FIG. 10.

Although this invention has been described in certain specific embodiments, many additional modifications and variations will be apparent to those skilled in the art. It is therefore to be understood that this invention may be practiced otherwise than as specifically described. Thus, the present embodiments of the invention should be considered in all respects as illustrative and not restrictive, the scope of the invention to be indicated by the appended claims rather than the foregoing description.

What is claimed is:

1. A printhead comprising:

a substrate with a first surface;

a fluid firing device deposited on the first surface, the fluid firing device having a heating element, defining a firing chamber about the heating element, defining a fluid channel fluidically coupled with the firing chamber and defining a fluid ejection orifice corresponding to the firing chamber; and a fluid reservoir positioned along the first surface, separate from the fluid firing device, and coupled with the fluid channel.

2. The printhead of claim 1 wherein the substrate is glass.

3. The printhead of claim 1 further comprising drive electronics deposited on the first surface and electronically coupled with the fluid firing device, wherein the drive electronics supplies power and signals to the fluid firing device to eject fluid from the fluid ejection orifice.

4. The printhead of claim 3 wherein the drive electronics include a control unit and an input connector coupled with a printer.

5. The printhead of claim 1 wherein the fluid firing device has thin film layers.

6. The printhead of claim 5 further comprising drive electronics deposited on the first surface and electronically coupled with the fluid firing device, wherein the thin film layers include a conductor layer that forms conductor traces that couple with the drive electronics.

7. The printhead of claim 5 wherein the thin film layers include a photoimagable polymer layer that forms the fluid channel, the firing ejection orifice, and the firing chamber.

8. The printhead of claim 1 wherein the firing chamber and the fluid ejection orifice are positioned over the heating element.

9. The printhead of claim 1 wherein the firing chamber has a top, a bottom, a first side, and a second side that is opposite the first side, wherein the bottom of the firing chamber faces the heating element, wherein the fluid channel enters the firing chamber from the first side, wherein the fluid is ejected from the firing chamber from the second side.

10. A printhead for ejecting fluid comprising:

a substrate having a first surface and a second surface;

a stack of thin-film layers grown aver said first surface of said substrate, said stack of thin-film layers further comprising an energy dissipating element, defining a firing chamber about the energy dissipating element, and defining a fluid channel; and a fluid reservoir positioned along the first surface of said substrate, the fluid reservoir coupled with and separate from the thin film stack, wherein the fluid channel fluidically couples the fluid reservoir and the firing chamber.

11. The printhead of claim 10 wherein the thin film stack includes a layer of cross-linking polymer having said firing chamber and an orifice chamber defined therein, the firing chamber being positioned over the energy dissipating element.

12. The printhead of claim 11 wherein the orifice chamber is positioned over the firing chamber and over the energy dissipating element.

13. The printhead of claim 12 wherein the firing chamber has a top, a bottom and sides, wherein the bottom of the firing chamber faces the energy dissipating element, wherein the orifice chamber faces one of the sides of the firing chamber.

14. A fluid ejection device comprising:

a substrate with a first surface;

a fluid ejector deposited on the first surface, the fluid ejector having a heating element, defining a firing chamber about the heating element, defining a fluid channel fluidically coupled with the firing chamber and defining a fluid ejection orifice corresponding to the firing chamber; and a fluid reservoir positioned along the first surface, separate from the fluid ejector, and coupled with the fluid channel.

15. The device of claim 14 further comprising drive electronics deposited on the first surface and electronically coupled with the fluid ejector, wherein the drive electronics supplies power and signals to the fluid ejector to eject fluid from the fluid ejection orifice.

16. The device of claim 15 wherein the drive electronics include a control unit and an input connector coupled with a printer.

17. A fluid ejection cartridge comprising:

a substrate having a first surface and a second surface;

a stack of thin-film layers formed over said first surface of said substrate said stack of thin-film layers further comprising an energy dissipating element, defining a firing chamber about the energy dissipating element, and defining a fluid channel; and a fluid reservoir positioned along the first surface of said substrate, the fluid reservoir coupled with and separate from the thin film sack, wherein the fluid channel fluidically couples the fluid reservoir and the firing chamber.

18. The device of claim 17 further comprising drive electronics deposited on the first surface and electronically coupled with the energy dissipating element, wherein the drive electronics supplies power and signals to the energy dissipating element to eject fluid from a fluid ejection orifice.

19. The device of claim 18 wherein the drive electronics include a control unit and an input connector coupled with a printer.

* * * * *